United States Patent [19]

Streit et al.

[11] Patent Number: 4,912,791

[45] Date of Patent: Apr. 3, 1990

[54] PRETREATMENT OF TEXTILE MATERIALS: ALKALINE SCOUR OR BLEACH WITH ORGANO-PHOSPHORUS COMPOUND

[75] Inventors: Werner Streit, Bobenheim; Wolfgang Schenk, Plankstadt; Matthias Kummer, Mannheim; Johannes P. Dix, Neuhofen; Alfred Oftring, Bad Duerkheim, all of Fed. Rep. of Germany

[73] Assignee: BASF Aktiengesellschaft, Ludwigshafen, Fed. Rep. of Germany

[21] Appl. No.: 268,339

[22] Filed: Nov. 7, 1988

[30] Foreign Application Priority Data

Nov. 7, 1987 [DE] Fed. Rep. of Germany ..... 3737890

[51] Int. Cl.[4] ..... D06M 13/26; D06M 1/06; C11D 7/56; D06L 1/12

[52] U.S. Cl. ..... 8/127.1; 8/101; 8/107; 8/116.1; 8/137

[58] Field of Search ..... 8/107, 127.1, 137

[56] References Cited

U.S. PATENT DOCUMENTS

| | | | |
|---|---|---|---|
| 3,122,417 | 2/1964 | Blaser et al. | 423/272 |
| 3,740,187 | 6/1973 | Kowalski | 8/111 |
| 3,766,078 | 10/1973 | Kowalski | 252/186.29 |
| 3,795,625 | 3/1974 | Kowalski | 252/186.29 |
| 3,855,284 | 12/1974 | Germscheid | 260/502.48 |

*Primary Examiner*—A. Lionel Clingman

*Attorney, Agent, or Firm*—Oblon, Spivak, McClelland, Maier & Neustadt

[57] ABSTRACT

Textile materials are pretreated in aqueous media by alkaline scouring and/or bleaching using an assistant comprising a compound of the general formula I

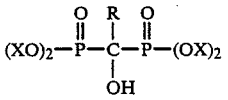

I where R is $C_6$–$C_{10}$–alkyl, X is H, Na, K or $NR^1R^2R^3R^4$, and $R^1$, $R^2$, $R^3$ and $R^4$ are each H, $C_1$–$C_4$–alkyl or $—CH_2—CH_2—OH$.

3 Claims, No Drawings

PRETREATMENT OF TEXTILE MATERIALS: ALKALINE SCOUR OR BLEACH WITH ORGANO-PHOSPHORUS COMPOUND

The present invention relates to a process for pretreating textile materials in aqueous media by alkaline scouring and/or bleaching using phosphorus-containing assistants and to the use of certain phosphorus-containing assistants in the pretreatment of textile materials.

The pretreatment of textile materials containing or consisting of cellulose, in particular cotton, has been known for a long time and is described in Ullmann's Encyklopädie der technischen Chemie, volume 9, Verlag Chemie 1975, pages 250 and 251 and volume 23, 1983, pages 19 to 31. The materials, which can be in the form of fiber, sliver, yarn, hanks, packages, woven fabric, knitwear or in some other state of processing, are prepared in the pretreatment for the subsequent gray state conversion steps, such as dyeing, printing, whitening and finishing.

The alkaline scour generally serves to swell the fiber and to degrade and/or partially extract interferants in order that the fiber may be prepared for the subsequent bleach and the interferants become easier to remove.

In the course of bleaching, customarily colored concomitants which have not been completely removed in the alkaline scour are usually destroyed oxidatively with peroxidic compounds but also with sodium chlorite or hypochlorite.

In the alkaline scour and in bleaching it is generally customary to use nitrogen-containing or phosphorus-containing assistants such as nitrilotriacetic acid, ethylenediaminetetraacetic acid, diethylenetriaminepentaacetate, gluconic acid or phosphonic acids, since they inter alia can form complexes with the heavy metal ions, such as $Fe^{2+}$ or $Fe^{3+}$, which are harmful in these processes. This property is utilized for example in bleaching for stabilizing oxidative bleaching agents.

For instance, DE-B-2,226,784 recommends a mixture of 1-hydroxyethylene-1,1-diphosphonic acid, nitrilotriacetic acid and a water-soluble magnesium or calcium salt for stabilizing peroxide compounds in aqueous alkaline solution. DE-B-2,211,578 discloses a mixture of polyhydroxy compounds with aminoalkanephosphonic acids derived from $C_1$- to $C_6$-alkanes and/or hydroxyalkanephosphonates derived from $C_1$- to $C_4$-alkanes and polyaminocarboxylic acids, for stabilizing peroxides.

However, existing nitrogen-containing stabilizers are not sufficiently effective on account of their high oxidation sensitivity. Their use together with phosphonic acids leads to an elaborate process which, owing to the use of a plurality of components, is unwieldy and not very economical and which in some instances leads to variable fabric appearance.

US-A-3,122,417 discloses using 1-hydroxyalkane1,1-diphosphonic acids derived from linear $C_1$- to $C_6$-alkanes as assistants for stabilizing peroxide compounds. However, the stabilizing action is inadequate.

The disadvantage with existing assistants containing phosphonic acid is that in water treatment plants they are difficult to eliminate from the effluent. For this reason expensive methods must be used to remove the assistants used, such as phosphonic acids.

It is an object of the present invention to provide a process for pretreating textile materials by alkaline scouring and/or bleaching which avoids the disadvantages mentioned, which is simple to carry out successfully and which uses assistants of high effectiveness which are easily removable from the effluent.

We have found that this object is achieved according to the invention with a process for pretreating a textile material in an aqueous medium by alkaline scouring and/or bleaching using a phosphorus-containing assistant comprising a compound of the general formula I where R is $C_6$- to $C_{10}$-alkyl, X is H, Na, K or

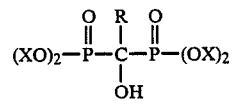

I $NR^1R^2R^3R^4$, and $R^1$, $R^2$, $R^3$ and $R^4$ are each H, $C_1$-$C_4$ alkyl or $—CH_2—CH_2—OH$.

We have also found a method of using assistants of the general formula I for pretreating textile materials in aqueous media by alkaline scouring and/or bleaching. The textile materials consist of cellulose fibers or contain cellulose fibers mixed with other fibers, for example viscose or polyester.

Preference is given to using compounds I where R is in particular branched $C_7$–$C_9$-alkyl, for example 2,4,4-trimethylpentyl or 1-ethylpentyl. X is preferably H, in particular Na.

Such compounds are known per se, for example from GB-C-1,469,894, GB-C-1,182,483 or DE-B-1,194,852 (incorporated by reference).

The amount used depends on the materials and apparatus used and ranges in general from 0.1 to 2, preferably from 0.1 to 1, % by weight, based on the aqueous medium. Alkaline scouring concentrations are best within the range from 0.3 to 1% by weight. Good results are obtained in bleaching using from 0.1 to 0.7% by weight, each percentage based on the aqueous media, a high level of bleaching agent of course dictating the use of high concentrations.

The method of addition is not critical. Compound I is added to the aqueous medium prior to the bleach or the alkaline scourer in a solid or dissolved form.

The aqueous media in which the alkaline scour is carried out generally contain large amounts of alkali, preferably from 5 to 100 g of NaOH per liter or equivalent amounts of KOH. For example, in a long liquor from 5 to 30 g of NaOH is used and in a short liquor, as in the impregnating method, from 40 to 100 g of NaOH, in each case based on 1 liter of aqueous medium. The scour is predominantly carried out at a liquor ratio of 1:1 and at from 90° to 130° C batchwise or continuously in a conventional manner in existing steamers or kiers. The treatment generally takes from 1 to 90 minutes.

The relationship between time, temperature and alkali concentration is known to those skilled in the art and may be utilized for optimization. Processing aids may be present in the form of known alkali-stable detergents such as fatty alcohol ethoxylates, alkali-stable wetting agents such as alkylsulfonates and reducing agents such as sulfite in customary amounts.

The bleach can be carried out oxidatively, for example with sodium chlorite or hypochlorite, perborates or with peroxidic substances, in particular hydrogen peroxide, which is customarily used as a from 35 to 50% strength by weight aqueous solution.

The amount of bleaching agent depends inter alia on the sensitivity of the textile material, the bleachability of the impurities and the apparatus used. It is customarily in the case of hydrogen peroxide (100% strength) from 0.7 to 30, preferably from 1.5 to 20, g/liter of aqueous medium. The remaining conditions depend also on the identity of the bleaching agent used. The pH is customarily from 5 to 14, preferably from 7 to 14, in particular from 9 to 13. It is generally set by means of acids such as acetic acid or alkalis such as NaOH or $Na_2CO_3$. The temperature is in general room temperature (cold bleach) or from 70° to 100° C. for a hot bleach. It is also possible to operate at 130° C. under a small superatmospheric pressure. The bleach can take from about 1 to 2 minutes in the case of a flash bleach, from 10 to 120 minutes in the case of a hot bleach or from 16 to 48 hours for a cold bleach. The liquor ratio (weight ratio of textile material to aqueous medium) can vary from 1:40 in a reel beck, through 1:5 for a typical short liquor to about 1:1 at extreme. Processing is continuous or batchwise in existing apparatus such as reel beck, J-box, U-box, flash steamers or combination steamers.

Additives used can be customary silicates such as sodium silicate in customary amounts. Minor amounts of silicates, for example from 0.1 to 0.85% by weight, based on the aqueous medium, can also successfully be used together with component I.

Known additives and substances such as buffers, for example sodium pyrophosphate, activators, for example formic acid or phthalic anhydride, or water-soluble magnesium or calcium salts, for example chlorides or sulfates, can likewise be present in the process according to the invention. Preferably, the process is carried out in an aqueous medium having a total hardness of from 2 to 20, in particular from 2 to 10, degrees dH (German hardness).

The novel process using component I is far superior to the existing pretreatment processes using customary assistants. Not only is the textile material not affected and the degree of bleaching high, but the bleaching agent is very efficiently stabilized by compound I. In addition, compound I is readily eliminated in water treatment plants, so that no costly purification and treatment steps are required.

EXAMPLES AND COMPARISONS

To test their stabilizing action on hydrogen peroxide in alkaline medium, 10 g of the assistants specified in Table 1 were dissolved in 800 ml of distilled water, if necessary with the addition of an adequate amount of NaOH. The pH was set to 7 with dilute sodium hydroxide solution or sulfuric acid. The amounts of NaOH specified in Table 1 were then added, and the solutions, after 20 ml of 35% strength by weight aqueous $H_2O_2$ had been added to each, were made up to 1 liter with distilled water.

The zero value corresponding to the peroxide content of the solution was determined in a conventional manner by titrating 5 ml of the solution with 0.1 N $KMnO_4$ solution.

100 ml portions of this peroxide solution were each admixed with 0.5 ml of aqueous test solution of the mixed catalyst and 1 ml of aqueous 1% strength by weight solution of $MgCl_2 \cdot 6H_2O$ and thermostated at 80° C. for 2 hours.

After cooling down to from 25° to 30° C. 5 ml portions were taken in each case within 10 minutes and titrated with 0.1 N $KMnO_4$ solution. By comparing with the zero value the residual peroxide percentage content is obtained.

PREPARATION OF MIXED CATALYST

Stock solution

In an Erlenmeyer flask, 1 g of $FeCl_3.6H_2O$, 0.1 g of $MnSO_4 \cdot H_2O$ and 0.1 g of $CuSO_4.5H_2O$ were dissolved in distilled water, 0.35 g of concentrated hydrochloric acid were then added, and sufficient distilled water was added to make up to 100 g.

This stock solution had to be clear. If precipitates appeared on prolonged standing, it was made up fresh.

Test solution 10 g of the above solution were then weighed into an Erlenmeyer flask and made up to 100 g with distilled water. The test solution always had to be made up fresh, since its stability was limited.

The mixed catalyst simulates in a reproducible manner the negative effect of heavy metals, in particular iron, on the stability of hydrogen peroxide.

The results of the tests are given in Table 1. Owing to the good stabilizing effect and very low magnesium concentrations, the Examples correspond to 2.76 degrees German hardness, the compounds of the formula I are suitable in particular for stabilizing hot bleaching baths, where low degrees of hardness produce fouling on the transportation rolls.

TABLE 1

| | Residual peroxide after 2 hours at 80° C. (% based on zero value) | |
|---|---|---|
| NaOH quantity | 1-Hydroxyhexane-1,1-diphosphonic acid (not according to the invention) 80° C. | Disodium salt of compound I with R = 1-ethylpentyl (according to the invention and X = Na) 80° C. |
| 10 g | 40.5 | 72.2 |
| 15 g | 12.4 | 44.0 |

We claim:

1. A process for pretreating a textile containing cellulose and other fibers which comprises alkaline scouring and/or bleaching said textile in an aqueous medium containing a compound of the formula:

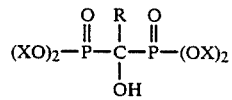

where R is a $C_{7-C9}$-alkyl, X is H, Na, K or $NR^1R^2R^3R^4$ and $R^1$, $R^2$, $R^3$ and $R^4$ are each H, $C_1$–$C_4$-alkyl or —$CH_2$—$CH_2$—OH.

2. A process as claimed in claim 1, wherein compound I is used in an amount of from 0.1 to 2% by weight, based on the aqueous medium.

3. A process as claimed in claim 1, wherein R is 2,4,4-trimethylpentyl or a heptyl X is Na.

* * * * *